US006009855A

United States Patent [19]

Espey

[11] Patent Number: 6,009,855

[45] Date of Patent: Jan. 4, 2000

[54] FUEL INJECTION SYSTEM FOR A MULTICYLINDE INTERNAL COMBUSTION ENGINE WITH A FUEL SUPPLY LINE SERVING AS HIGH PRESSURE STORAGE DEVICE

[75] Inventor: Christoph Espey, Waiblingen, Germany

[73] Assignee: DaimlerChrysler AG, Stuttgart, Germany

[21] Appl. No.: 09/161,559

[22] Filed: Sep. 28, 1998

[30] Foreign Application Priority Data

Oct. 22, 1997 [DE] Germany ..... 197 46 568

[51] Int. Cl.[7] ..... F02M 37/04

[52] U.S. Cl. ..... 123/456; 123/509

[58] Field of Search ..... 123/456, 470, 123/472, 469, 468, 509

[56] References Cited

U.S. PATENT DOCUMENTS

| | | | |
|---|---|---|---|
| 4,221,192 | 9/1980 | Badgley | 123/456 |
| 4,756,289 | 7/1988 | Rock | 123/463 |
| 4,798,186 | 1/1989 | Ganser | 123/458 |
| 4,946,106 | 8/1990 | Turchi | 123/458 |
| 5,101,800 | 4/1992 | Schumann | 123/456 |
| 5,277,156 | 1/1994 | Osuka et al. . | |
| 5,398,658 | 3/1995 | Mesimäki | 123/456 |
| 5,482,021 | 1/1996 | Roche | 123/456 |
| 5,699,770 | 12/1997 | Matsumoto | 123/470 |
| 5,752,487 | 5/1998 | Harrell et al. . | |
| 5,806,494 | 9/1998 | Glassey | 123/456 |

FOREIGN PATENT DOCUMENTS

| | | |
|---|---|---|
| 41 35 292 | 5/1992 | Germany . |
| 42 92 209 | 1/1993 | Germany . |
| 43 22 480 | 1/1995 | Germany . |
| 296 10 765 U | 12/1996 | Germany . |
| 295 21 402 U | 6/1997 | Germany . |
| 196 00 536 | 7/1997 | Germany . |
| 9-60562 | 8/1995 | Japan . |
| 2 219 951 | 12/1989 | United Kingdom . |

*Primary Examiner*—Carl S. Miller
*Attorney, Agent, or Firm*—Klaus J. Bach

[57] ABSTRACT

In a fuel injection system for a multicylinder internal combustion engine having cylinders arranged in a line, an injector with an injector mounting body and an injector nozzle supported on each cylinder and a high pressure fuel supply line extending along the injector mounting bodies, the high pressure fuel supply line is firmly connected to the injector mounting bodies to form a unitary structure through which fuel is directly supplied from the high pressure fuel supply line to the fuel injectors and a high pressure fuel supply pump is connected directly to the fuel supply line for supplying fuel under pressure thereto.

5 Claims, 2 Drawing Sheets

FUEL INJECTION SYSTEM FOR A MULTICYLINDE INTERNAL COMBUSTION ENGINE WITH A FUEL SUPPLY LINE SERVING AS HIGH PRESSURE STORAGE DEVICE

BACKGROUND OF THE INVENTION

The invention relates to a fuel injection system for a multicylinder internal combustion engine including a fuel supply line extending along the cylinders and serving as a high pressure storage device which is in communication with injection valves disposed in receiving wells formed in the cylinder head.

Such a fuel injection system is known from U.S. Pat. No. 5,277,156, wherein a high pressure pump supplies fuel through a transmission line to a supply line from which injection lines extend to the respective injection valves of the multicylinder internal combustion engine.

DE 42 92 209 T1 discloses a fuel injection system for a six-cylinder internal combustion engine with a multi-passage supply line extending along the cylinders and being firmly mounted onto the cylinder heads by screws. The injection valves form, together with the pump elements which generate the high pressure needed for the injection, an injection arrangement disposed in the cylinder head.

It is the object of the present invention to minimize the chances of leakage of the connecting lines which are under high fuel pressure by relatively simple measures for the fuel injection system and, furthermore, to simplify the assembly of the components carrying the fuel.

SUMMARY OF THE INVENTION

In a fuel injection system for a multicylinder internal combustion engine having cylinders arranged in a row, an injector with an injector mounting body and an injector nozzle supported on each cylinder and a high pressure fuel supply line extending along the injector mounting bodies, the high pressure fuel supply line is firmly connected to the injector mounting bodies to form a unitary structure through which fuel is directly supplied from the high pressure fuel supply line to the fuel injectors. A high pressure fuel supply pump is connected directly to the fuel supply line for supplying fuel under pressure thereto.

With the arrangement according to the invention, wherein a direct flow connection is established between the supply pipe serving as high pressure storage structure and the respective mounting structures for the magnetic valve controlled injectors without intermediate separate injection lines, the amount of parts is reduced and consequently a cost effective, space-saving design is provided. In addition, the chances of leakages are substantially reduced by the elimination of the injection lines.

The supply line may additionally serve as a support element for supporting cable guide structures and/or auxiliary components.

In a particular embodiment of the invention, the injection pump disposed at the end of the supply line has a housing integrally formed with the high pressure pump.

The supply line and the respective support structures of the injection valves as well as the housing of the high pressure pump can be formed as a single forging.

The supply line may be attached to the support structures at their heads or at their sides whatever is most suitable.

Some embodiments of the invention will be described below in greater detail on the basis of the accompanying drawings.

BRIEF DESCRIPTIONS OF THE DRAWINGS

FIG. 1 shows a fuel supply line with injection valve mounting structures having top ends formed integrally with the fuel supply line, FIG. 2 is a view of the supply line taken from one side of FIG. 1, and FIG. 3 shows an injector mounting structure with the fuel supply line disposed at one side of the injector mounting structures.

DESCRIPTION OF PREFERRED EMBODIMENTS

Figure 1:
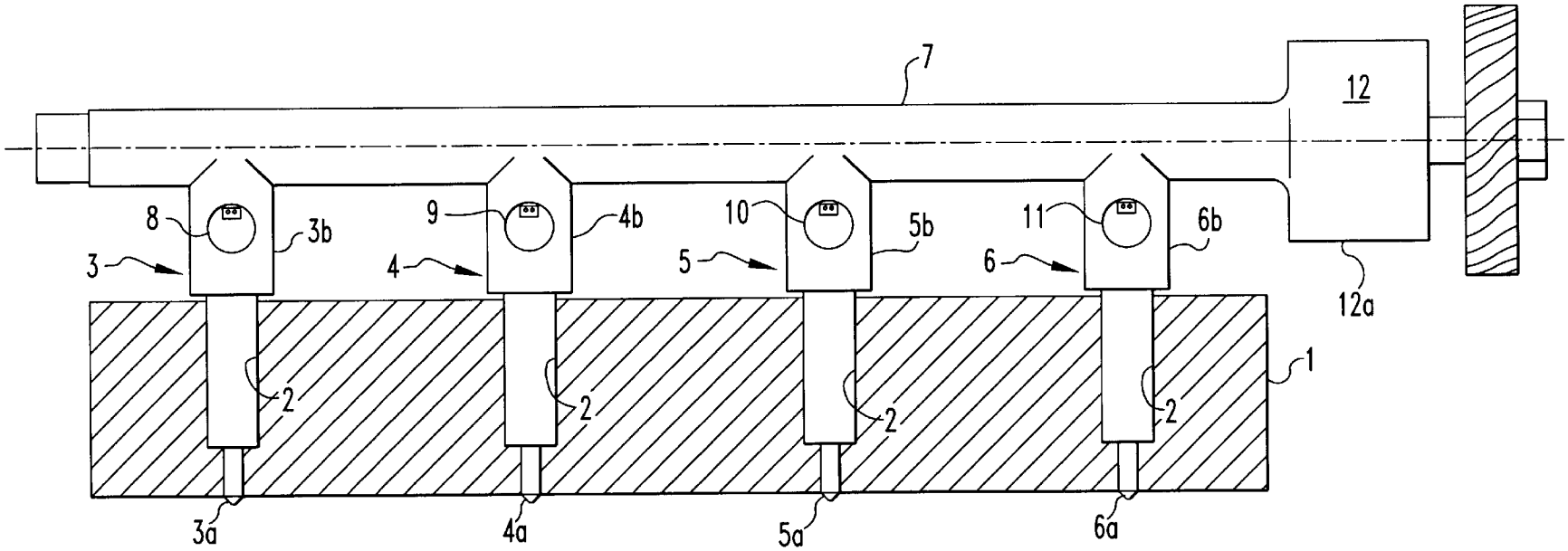

As shown in FIG. 1, a cylinder head 1 of a four cylinder internal combustion engine includes wells 2 in which magnetic valve-controlled injectors 3, 4, 5 and 6 are disposed.

Each injector consists essentially of an injection nozzle 3*a*, 4*a*, 5*a*, 6*a* and a mounting body 3*b*, 4*b*, 5*b*, 6*b*, which is disposed partially in the well 2 in the cylinder head 1 and partially projects from the cylinderhead 1.

A fuel supply line 7 extends over the full length of the cylinder head 1 and acts as a high pressure storage supply line 7 (common rail). The high pressure supply line 7 is directly connected to each injector without intermediate injection lines, that is, the mounting bodies 3*b*, 4*b*, 5*b*, 6*b* of the injectors 3, 4, 5, 6, are formed onto the fuel supply line 7, or they are integrally formed with the fuel supply line 7.

Preferably, the fuel supply line 7 and the support bodies 3*b* to 6*b* consist of a single-piece forging.

Each mounting body 3*b* to 6*b* is provided with a magnetic valve 8, 9, 10 11, the magnetic valves being mounted on the sides of the respective mounting bodies 3*b*, 4*b*, 5*b*, 6*b* between the supply line 7 and the cylinder head 1.

At one end of the high pressure supply line 7, there is a high pressure pump 12, which constantly supplies fuel under pressure to the fuel supply line 7. The high pressure pump 12 includes a housing 12*a*, which is—like all the mounting bodies 3*b*, 4*b*, 5*b*, 6*b*,—formed integrally with the supply line 7 so that they all together consist of a single-piece structure.

Figure 3:
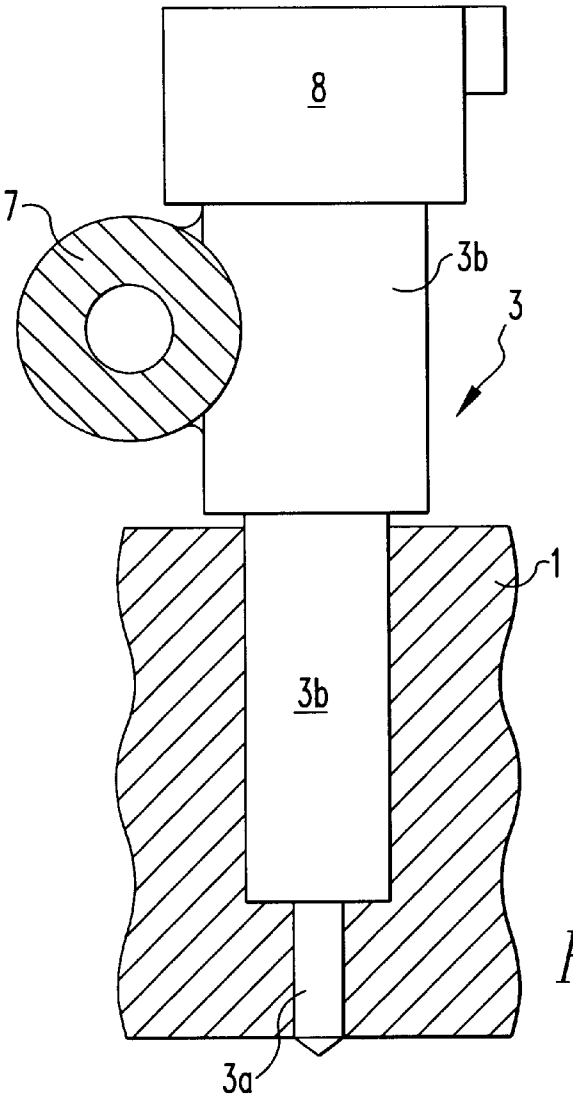
Figure 2:
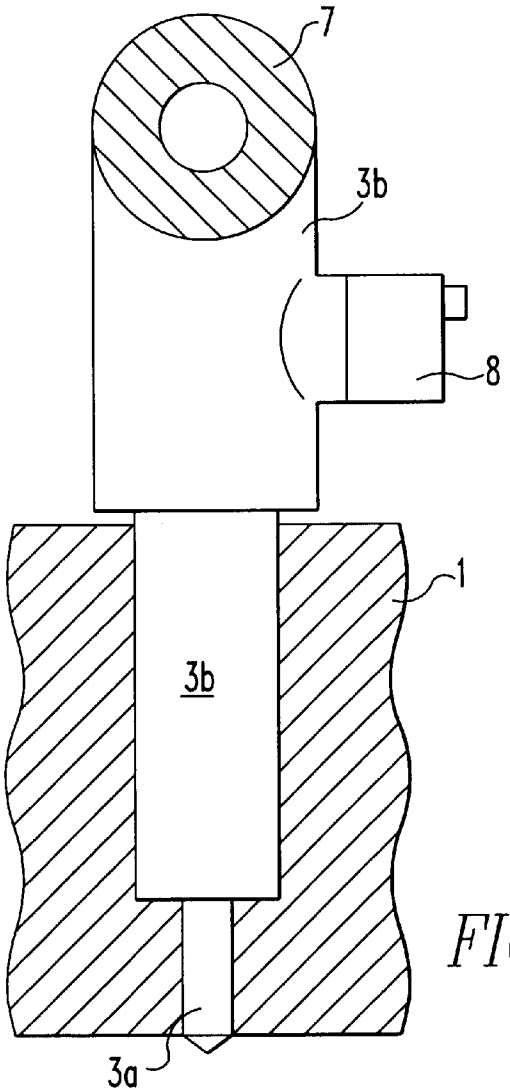

FIG. 3 shows an embodiment wherein the supply line 7 is not disposed at the top ends of the mounting bodies of the injectors, but is disposed at the sides of the mounting bodies. The magnetic valves 8, 9, 10, 11 may then be disposed at the top of the mounting bodies 3*b*, 4*b*, 5*b*, 6*b*, thereby forming the head portions of the injectors.

What is claimed is:

1. A fuel injection system for a multicylinder internal combustion engine having cylinders arranged in a line, an injector with an injector mounting body and an injector nozzle supported on each cylinder, a tubular fuel storage high pressure supply line extending along said injector mounting bodies and being firmly connected thereto so as to represent a unitary structure in direct communication with said injectors for supplying fuel under pressure thereto, each of said fuel injector mounting bodies including a magnetic valve for controlling the fuel supply from said high pressure supply line to said injector nozzles and a high pressure fuel supply pump including a housing connected to said tubular fuel storage high pressure fuel supply line at one end thereof so as to form a unit with said tubular fuel storage high pressure fuel supply line for supplying fuel under pressure thereto.

2. A fuel injection system according to claim 1, wherein said tubular fuel storage high pressure supply line extends along the sides of said injector mounting bodies and said magnetic valves are disposed at the ends of said injector mounting bodies.

3. A fuel injection system according to claim 1, wherein said tubular fuel storage high pressure supply line extends at the top ends of said injectors mounting bodies and said magnetic valves are disposed on the sides of said injector mounting bodies.

4. A fuel injection system according to claim 1, wherein said tubular fuel storage high pressure supply line is integrally formed with said injector mounting bodies.

5. A fuel injection system according to claim 1, wherein said magnetic valves are integrally formed with said injector mounting bodies.

* * * * *